US006537044B2

(12) United States Patent
Chang et al.

(10) Patent No.: US 6,537,044 B2
(45) Date of Patent: Mar. 25, 2003

(54) SCROLL COMPRESSOR SEALING UNIT STRUCTURE

(76) Inventors: Lung-Tsai Chang, P.O. Box No. 6-57, Chung-Ho City, Taipei Hsien 235 (TW); Guang-Der Tarng, P.O. Box No. 6-57, Chung-Ho City, Taipei Hsien 235 (TW); Mao-Chuan Liu, P.O. Box No. 6-57, Chung-Ho City, Taipei Hsien 235 (TW); Yeng-Chyi Liu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/924,726

(22) Filed: Aug. 9, 2001

(65) Prior Publication Data

US 2003/0031575 A1 Feb. 13, 2003

(51) Int. Cl.[7] ..... F04C 18/04
(52) U.S. Cl. ..... 418/55.4; 418/55.5
(58) Field of Search ..... 418/55.4, 55.5, 418/57

(56) References Cited

U.S. PATENT DOCUMENTS 5,474,433 A * 12/1995 Chang et al. ..... 418/55.4
6,048,184 A * 4/2000 Chang et al. ..... 418/55.4

* cited by examiner

*Primary Examiner*—John J. Vrablik
(74) *Attorney, Agent, or Firm*—Troxell Law Office PLLC

(57) ABSTRACT

The present invention is related to a scroll compressor sealing unit structure, more particularly, a floating bearing and seal washer joined together so that the inverted edge of a slanting edge together form a slanting edge, and that a round cap together with a seal washer are fitted into the inverted edge of the floating bearing to form a single unit, and that the bottom edge of the rounded cap fit into the inverted and sloping edge of the floating bearing, so that the seal washer is able to act as a sealing unit in the space defined by this connection, and in this way ensure that in the fitting together of the round cap and seal washer a firm and fully sealed connection is effected.

5 Claims, 6 Drawing Sheets

SCROLL COMPRESSOR SEALING UNIT STRUCTURE

BACKGROUND OF THE INVENTION

1. Field of the Invention

The present invention, a scroll compressor sealing unit structure, provides a seal washer and a floating bearing that connect to form a secure closure with a sealing effect, or a sealed unit structure, so that when a round cap moves downward as a result of downward pressure exerted by a high-pressure chamber, an inverted enclosure with a slanting edge will act to prevent material damage or distortion in shape; and in instances where the seal washer is flat in shape, when the cap and floating bearing come together, by using making use of a PU-constructed seal washer, the material of the seal washer is able to fill in the space of inverted and slating edge of the connection via a rising up action, and moreover, polytetrafluoroethylene is a material less likely to be damaged by the effect of the refrigerant.

2. Description of the Prior Art

FIG. 1 shows the structure of a conventional scroll compressor, wherein, the main components in the interior of a compressor (A) comprising an insulating enclosure (B), as well as a low-pressure chamber (A1) and a high-pressure chamber (A2), located on either side of this sealed space. On the respective sides of the low-pressure chamber (A1) and the high-pressure chamber (A2) are located refrigerant inlet (A11) and refrigerant outlet (A12), and on the side of the lower-pressure chamber (A1) and below insulating enclosure (B), is located a fixed scroll (C1) and an orbiting scroll (C2). An Activator (C3) acts to rotate the orbiting scroll (C2), and the effect of the motion within the fixed scroll (C1) and the orbiting scroll (C2) is to produce a sucking effect that draws refrigerant from the low-pressure chamber (A1), creating pressure which acts to change the volume of the refrigerant, so that the high-pressure refrigerant is forced through insulating enclosure's (B) connecting compartment (B1) to enter the high-pressure chamber (A2) through a discharge outlet (C11) on the fixed scroll (C1), and the said refrigerant is then discharged through a refrigerant outlet (A21) into the piping of compressor (A), and in this way a circulating system of heat exchange is maintained.

Because of the high-speed revolving motion of ht orbiting scroll (C2) in the fixed scroll (C1), it is vital that the connections in respect to both of these parts be secure and stable, and for this reason a pressure vessel section (B2) is affixed to the half-way point of the insulating enclosure (B), and connects to the sides of the high-pressure pressure chamber (A2) and the fixed scroll (C1), so that a pressure control set (D) on the pressure vessel section (B2) is able to act as a restraining force in respect to fixed scroll (C1), the main part of control set (D) being a floating bearing (D2), also located on the pressure vessel section (B2), and the floating bearing (D2) moves in response to the pressure effect of the pressure vessel section (B2). One other part of the floating bearing (D2), and located on its lower part, is a flexible plate (D4), and a pressure resister enclosure (D3), and the flexible plate (D4) together with the pressure resister enclosure (D3) form a pressure control unit in respect to fixed scroll (C1), so that the pressure effect of the high-pressure chamber (A2) acts in tandem with the floating bearing (D2) to effect a downward pressure, acting to ensure that fixed scroll (C1) and orbiting scroll (C2) are securely and firmly fitted together, and that the revolving motion of the orbiting scroll (C2) is kept steady and free from vibration, and the subsequent occurrence of noise. With the same structure as the aforementioned set up, the pressure control set is positioned on the center of the top part of the fixed scroll, and is acted on by an evenly distributed field of force.

The main function of the compressor (A) is to change low-temperature refrigerant into high-temperature refrigerant. Therefore, to prevent refrigerant from the high-pressure chamber (A2) from leaking into the low-pressure chamber (A1), and thus decreasing the working efficiency of the compressor (A), it is extremely important that the area between high-pressure chamber (A2) and low-pressure chamber (A1) be securely sealed. With this purpose in mind, the pressure control set (D) acts together with another set, seal washer (E), to ensure that the area in pressure vessel section (B2) is securely sealed to avoid leakage of refrigerant. From FIG. 2 it can be seen that seal washer (E), made from a plastic material, has an inverted structure, and is placed in the space between a round cap (D1) and the floating bearing (D2), and thus acts to close and seal the space defined by the inner-edge of a seal washer (E) and the inner wall of the pressure vessel section (B2).

Because the underneath edge of seal washer (E) is fixed by means of pressure directly with the flat surface area of floating bearing (D2), an unclosed space exists between the underneath edge of the seal washer (E) and the inner wall of the pressure vessel (B2), and when the round cap (D1) is pressed downwards from the pressure of the high-pressure chamber, the gap remains unclosed, so that a pushing pressure can be exerted on the seal washer (E), resulting in damage and/or distortion, and the danger of damage is especially strong in respect to the refrigerant, which is capable of causing extensive damage to plastic materials.

SUMMARY OF THE INVENTION

In respect to the space between the floating bearing and the seal washer, the primary objective of the present invention is to provide a structure comprising an inverted edge placed against another inverted edge to form a sloping edge, so that a round cap and a seal washer form a single unit able to fit into the inverted space of a floating bearing to form a single sealed unit, and in this way the outer edge of the unit formed by the round cap and seal washer fits into the inverted and sloping space of the floating bearing, thereby creating a sealed space effectively sealing the space made in the connection between the round cap and the floating bearing, which is the main object of the present invention. The other object of the present invention relates to the sealed connection between the inverted and sloping edge and the underneath edge of the seal washer, in that when the round cap pushes downward as a result of pressure received from the high-pressure chamber, the inverted and sloping edge of the seal washer acts to limit the effects of this pressure and thereby to prevent the material from being damaged or becoming distorted in shape.

One other object of the present invention, is to make use of polytetrafluoroethylene material in instances where a flat-shaped seal washer is used, so that when the round cap and the floating bearing come together, the polytetrafluoroethylene material is able to fill in the gap of the inverted and slanting edge by a rising up motion, and in this way provide a more securely sealed connection, and, moreover, polytetrafluoroethylene is better able to resist the corrosive properties of refrigerant.

DETAILED DESCRIPTION OF THE PREFERRED EMBODIMENTS

Figure 1:
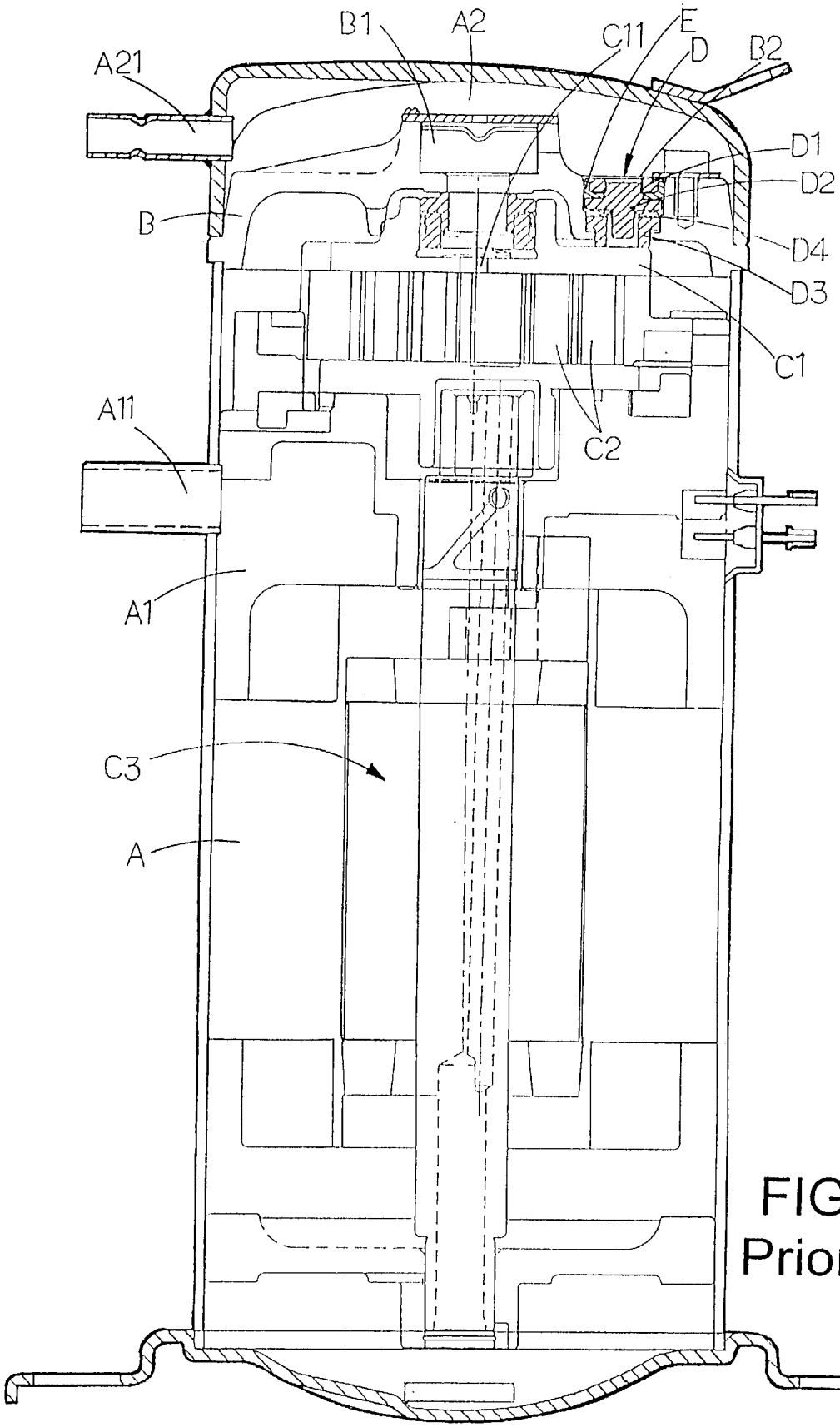
FIG.1 Prior Art
FIG. 1 is a cross-sectional drawing of a conventional scroll compressor.
Figure 2:
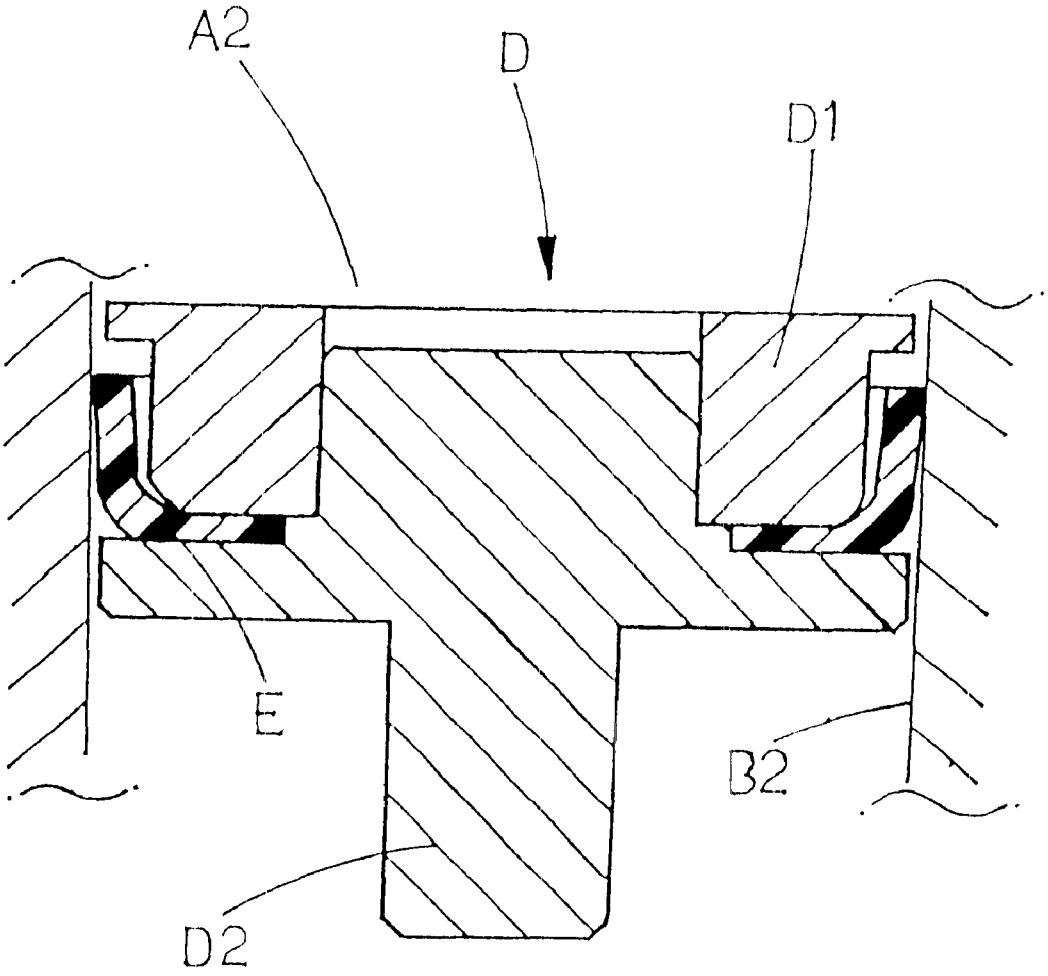
FIG.2 Prior Art
FIG. 2 is a cross-sectional drawing of the sealed structure of a conventional scroll compressor.
Figure 3:
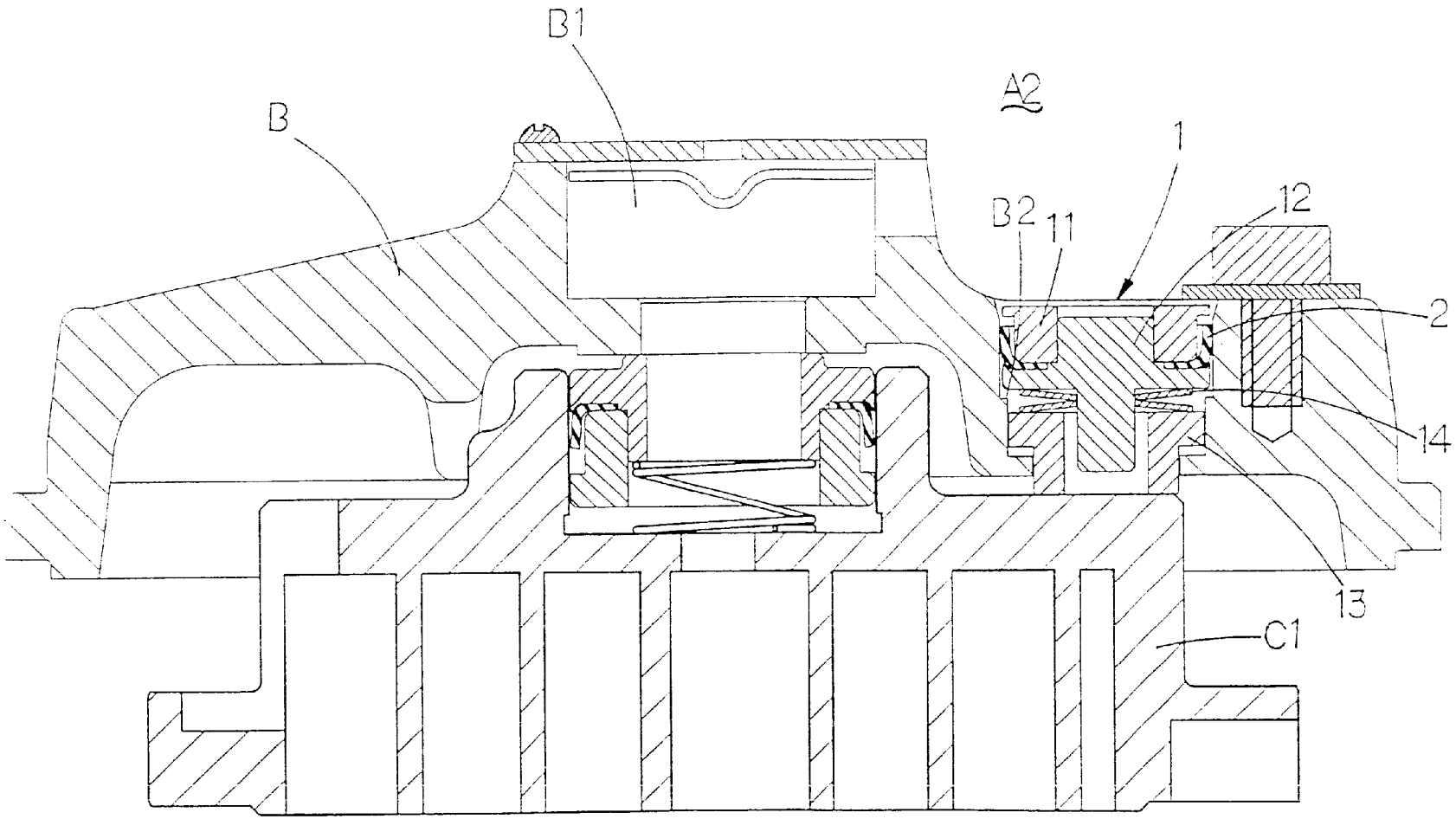
FIG. 3 is a cross-sectional drawing of the assembled state of the sealing unit of the present invention.

The primary appliances relating to the present invention are shown in FIG. 3, wherein a plurality of pressure vessel sections (B2) connecting to the sides of a high-pressure chamber (A2) and a fixed scroll (C1) are positioned on the compressor's insulating enclosure (B), as located in the structure of the compressor's high-pressure chamber and low-pressure area. Furthermore, a pressure control set (1) is positioned on the pressure vessel section (B2) so as to perform a pressure resistance function in respect to the fixed scroll (C1). The most important part of the pressure control set is a floating bearing (12) as located on the pressure vessel section (B2), and which moves in relation to pressure vessel section(B2), and, moreover, on the top part of the floating bearing (12) a round cap (11) is positioned, and on the bottom part of the floating bearing (12) a flexible plate (14) and a pressure resistance enclosure (13) are positioned, so that the flexible plate (14) and the pressure resistance enclosure (13) work together to create a pressure control effect in respect to the side of the fixed scroll (C1), as well as working together with floating bearing (12) to exert a pressure effect on the high-pressure chamber (A2), so as to securely seal together fixed scroll (C1) and orbiting scroll (C2), and by so doing ensure that the revolving motion of orbiting scroll (C2) is kept stable and free from vibration and subsequent noise. The pressure control set is structured in the same way, and is positioned on the middle-top part of the fixed scroll, so that it receives an evenly distributed amount of pressure, and moreover, in the space joining the round cap (11) and the floating bearing (12), a seal washer is positioned, so that the space joining the round cap (11) and the floating bearing (12), as well as the space adjoining the inner wall of the pressure vessel section (B2), is kept securely sealed.

Figure 4:
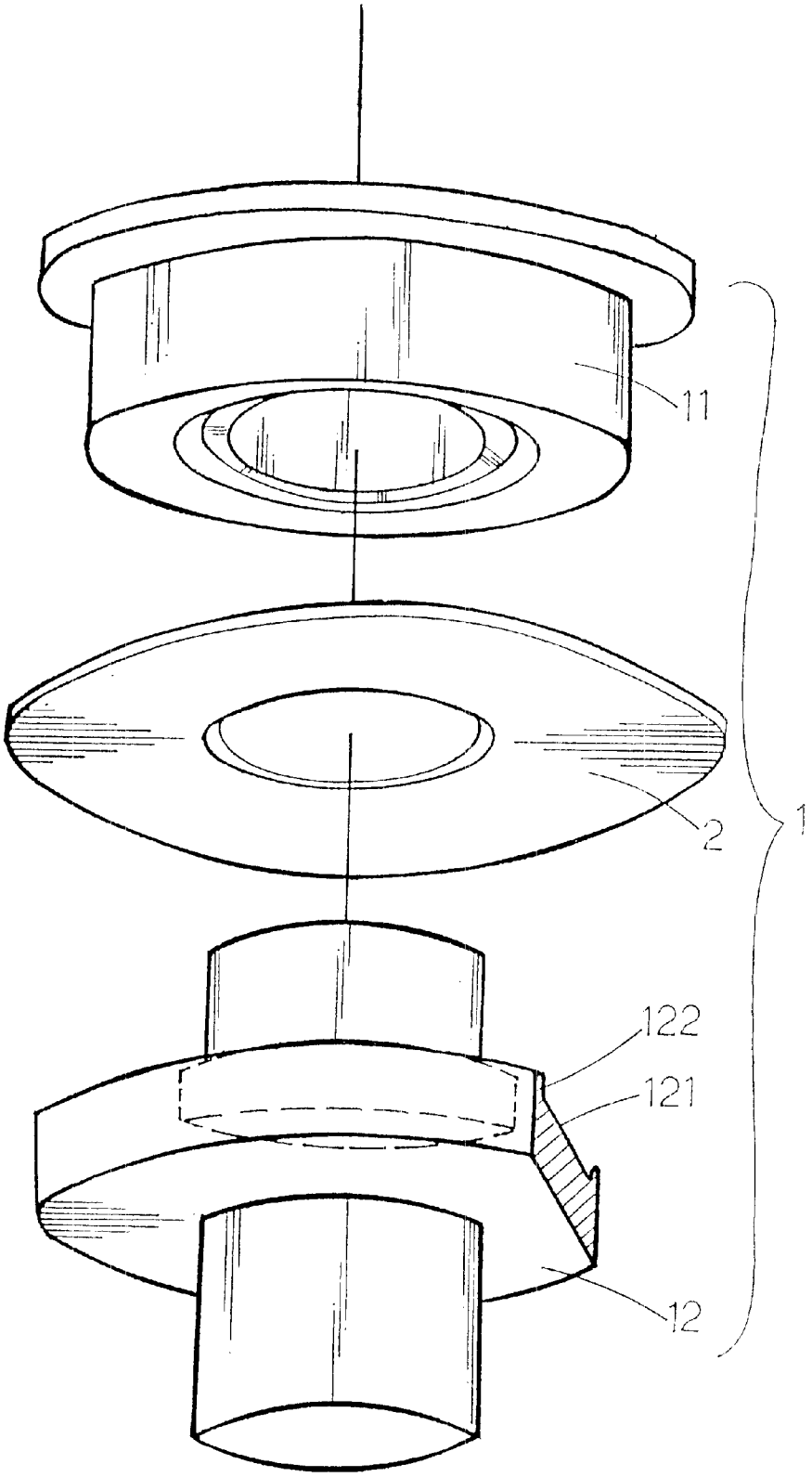
FIG. 4 is an exploded drawing of the sealing unit of the present invention.
Figure 5:
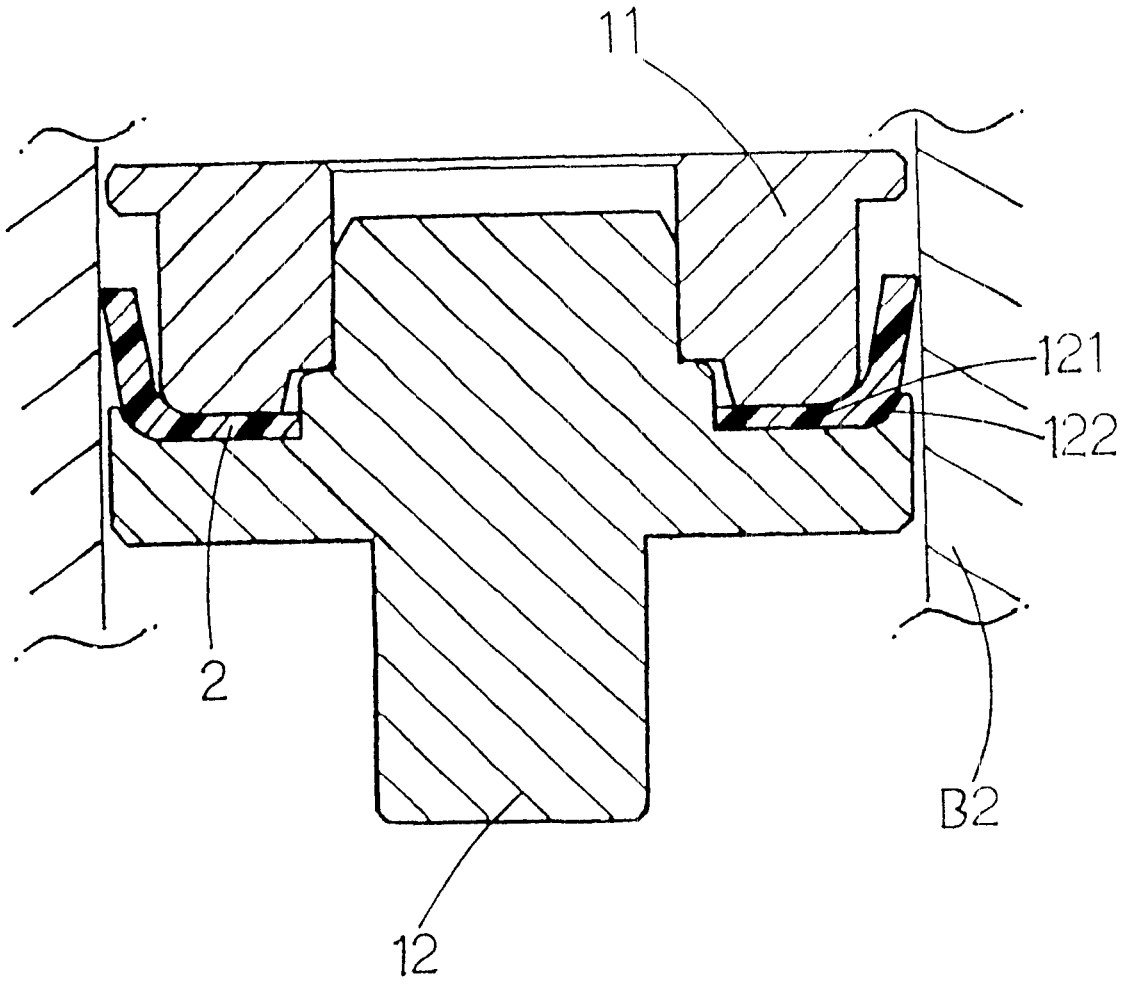
FIG. 5 is a cross-sectional drawing of the sealing unit of the present invention.
Figure 6:
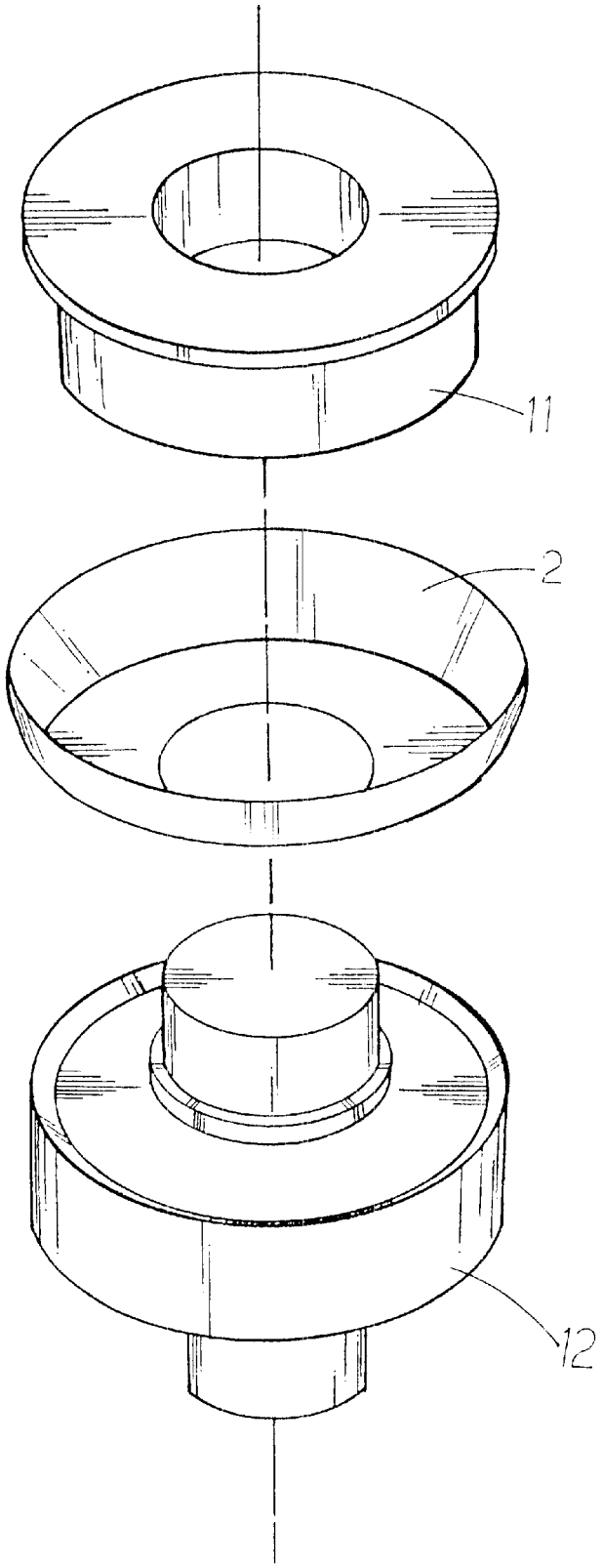
FIG. 6 is an exploded drawing of another aspect of the sealing unit of the present invention.

Referring to FIGS. 4 and 5; the primary part of the present invention relates to the space joining the floating bearing (12) and the seal washer (2), which is shaped to form an inverted edge (121), so that the outer edge of the inverted edge (121) is shaped to form a slanting edge (122), so that the round cap (11) and seal washer (2) together with the inverted edge (121) of floating bearing (12) join together to form a single unit, and in the ear between the underneath edge of the round cap (11) and the slanting edge (122) part of the inverted edge of the floating bearing (12), a seal washer (2) is inserted to so as to produce a sealing effect, and in this way the seal washer (2) fits together to form a single flat installation, and because it is constructed from polytetrafluoroethylene, in acting to seal the space between the round cap (11) and the floating bearing (12), the seal washer 2 is able to rise up to fill the inverted edge (121) of the slanting edge (122), and is able to press against the inner walls of the pressure vessel section B, to form a more tightly sealed unit. In the same way as is shown in FIG. 6, the seal washer (2) of the present invention is equipped with a structure enabling it to fit together with the round cap (11) and the floating bearing (12) so as to form a fully sealed and inverted-type shape, and in this way these three units are together able to produce a more leakage-resistant effect.

Because the inverted edge (121) and the slanting edge (122) form a securely sealed unit with the bottom edge of seal washer (2), when round cap (11) is forced downwards from pressure exerted by the high-pressure chamber, the inverted edge (121) and the sloping edge (122) act to limit the effect of this on seal washer (2), and thus prevent the material from breaking or becoming distorted in shape; and, moreover, because the seal washer (2) is constructed from polytetrafluoroethylene, it is less likely to be damaged by the refrigerant.

The present invention is one in which a floating bearing is fitted together with a seal washer so as to form a connection in which one inverted edge fits together with a sloping inverted edge to form a single sloping edge, and the unit formed by the joining together of the round cap and the seal washer is such that it is able to fit together with a floating bearing to form a single sealed unit. Moreover, the space between the bottom edge of the round cap and the inverted sloping part of the floating bearing, is such that a seal washer can be used to seal this space, which besides acting to better secure and to seal the connection between the seal washer and the floating bearing, is able to, through the tightly secured seal existing on the sloping edge of the inverted edge in the space defined by the bottom edge of the washer, limit the effect produced when the round cap is forced downwards from pressure from the high-pressure chamber, by virtue of the limiting effect produced by the inverted and sloping design of this space. In presenting an alternative and improved structure for a scroll compressor, a formal request for the granting of patent rights is hereby made.

We claim:

1. A scroll compressor sealing unit structure, for sealing a space defined by the structures of a low-pressure chamber and high pressure chamber, wherein, an insulated enclosure of a compressor including a fixed scroll, an orbiting scroll, and a pressure control set positioned on a pressure vessel section of the insulated enclosure to exert a pressure resisting force on the fixed scroll, the pressure control set including a floating bearing positioned on the pressure vessel section, the floating bearing having a pressure exerting function and movable in relation to the pressure vessel section, a round cap is positioned on an upper part of the floating bearing, so that together with the floating bearing the round cap exerts a downward pushing motion with respect to the high-pressure chamber, enabling the fixed scroll and the orbiting scroll to stay fixed together, and to thereby ensure that rotating motion of the orbiting scroll is kept stable, and free from vibration and subsequent noise; a space between the round cap and the floating bearing fitted with a seal washer in contact with an inner wall of the pressure vessel section to form a secured and sealed unit, the floating bearing having an inverted edge with a sloping edge thereon, such that a bottom edge of the seal washer fully seals against the inverted and sloping edges, so that when the round cap is forced downwards as a result of downward pressure from the high-pressure chamber, the inverted and sloping edges prevents the seal washer from becoming distorted in shape or damaged.

2. The scroll compressor sealing unit structure in accordance with claim 1, wherein, the said seal washer is flat such that when a sealing unit is placed inside a space between the rounded cap and the floating bearing, an outer edge of the seal washer rises up to fill a space between the sealing unit and an inner wall of the pressure vessel section can be tightly sealed.

3. The scroll compressor sealing unit structure in accordance with claim 1, wherein, the seal washer is made of polytetrafluoroethylene.

4. The scroll compressor sealing unit structure in accordance with claim 1, wherein, positioned on a lower part of the floating bearing is a flexible plate.

5. The scroll compressor sealing unit structure in accordance with claim 1, wherein, a pressure control set is positioned on center-top part of the fixed scroll, to receive an evenly distributed amount of pressure.

* * * * *